US008079390B2

(12) United States Patent
Bigsby et al.

(10) Patent No.: US 8,079,390 B2
(45) Date of Patent: Dec. 20, 2011

(54) PROCESS OF PRODUCTION OF DISPOSABLE WOODEN CUTLERY AND PRODUCT THEREOF

(75) Inventors: Terence John S. Bigsby, Lumby (CA); Robert A. Bigsby, Lumby (CA); Claus R. Gerlach, Vernon (CA)

(73) Assignee: Aspenware Inc., Vernon, British Columbia ( * ) Notice: Subject to any disclaimer, the term of this patent is extended or adjusted under 35 U.S.C. 154(b) by 455 days.

(21) Appl. No.: 12/076,635

(22) Filed: Mar. 20, 2008

(65) Prior Publication Data

US 2008/0178966 A1 Jul. 31, 2008

(51) Int. Cl.
*B27D 1/00* (2006.01)

(52) U.S. Cl. ..... 144/348; 144/359

(58) Field of Classification Search ..... 144/360, 144/364, 348, 2.1, 330, 331, 332, 346, 359, 144/361, 347, 380
See application file for complete search history.

(56) References Cited

U.S. PATENT DOCUMENTS

| | | | | | |
|---|---|---|---|---|---|
| D52,878 | S | | 1/1919 | Graseberger | |
| D53,588 | S | | 7/1919 | Graseberger | |
| 1,435,890 | A | | 11/1922 | Bothe | |
| 1,448,180 | A | | 3/1923 | Atwood | |
| 1,461,686 | A | | 7/1923 | Stone | |
| 1,645,936 | A | * | 10/1927 | Schlesinger | 144/268 |
| 1,897,809 | A | | 2/1933 | Lilley | |
| 2,025,120 | A | * | 12/1935 | Meyers | 206/760 |
| 2,095,389 | A | * | 10/1937 | Kondolf | 493/62 |
| 2,346,040 | A | | 4/1944 | Montague | |
| 2,370,429 | A | * | 2/1945 | Vidal | 114/357 |
| 2,375,994 | A | * | 5/1945 | Johnson | 280/610 |
| 2,388,485 | A | * | 11/1945 | Jensen | 156/182 |
| 2,401,534 | A | | 6/1946 | Welch | |
| 2,452,226 | A | | 10/1948 | Cone | |
| 2,454,113 | A | | 11/1948 | Ake | |
| 2,458,864 | A | * | 1/1949 | Lindsay | 156/224 |
| 2,536,335 | A | * | 1/1951 | Weyant | 156/583.1 |
| 2,593,709 | A | * | 4/1952 | Ware, Jr. et al. | 242/560.3 |
| 2,634,497 | A | | 4/1953 | Waldesbuehl | |
| 2,824,369 | A | | 2/1958 | Welch | |
| 3,449,194 | A | | 6/1969 | Scheffler et al. | |
| 3,964,161 | A | | 6/1976 | Wise | |
| 3,975,839 | A | | 8/1976 | Taber | |
| 4,151,319 | A | | 4/1979 | Sackoff et al. | |
| D259,575 | S | | 6/1981 | Nagode | |

(Continued)

FOREIGN PATENT DOCUMENTS

CA 2027848 A * 4/1991

(Continued)

OTHER PUBLICATIONS

U.S. Appl. No. 10/569,507, Allen.

(Continued)

*Primary Examiner* — Gregory Huson
*Assistant Examiner* — Jennifer C Chiang
(74) *Attorney, Agent, or Firm* — Antony C. Edwards

(57) ABSTRACT

A disposable wooden utensil includes a handle having a distal end and an opposite neck end. A load-engaging member extends cantilevered from the neck end in generally coplanar alignment with the handle so as to form a neck between the handle and the load-engaging member. A raised dorsal ridge is formed substantially medially along the handle and extends substantially along the load-engaging member.

9 Claims, 13 Drawing Sheets

U.S. PATENT DOCUMENTS

| | | | | |
|---|---|---|---|---|
| 4,332,409 | A | 6/1982 | Stachowicz | |
| 4,589,204 | A | 5/1986 | Vogel | |
| 4,734,984 | A | 4/1988 | Snell et al. | |
| 4,771,541 | A | 9/1988 | Bouchakian | |
| 4,809,435 | A | 3/1989 | Printz | |
| 4,835,860 | A | 6/1989 | Infeld | |
| 4,863,033 | A | 9/1989 | Buj | |
| 4,969,268 | A | 11/1990 | Kelly, III | |
| 4,984,367 | A | 1/1991 | Albanese | |
| 5,075,975 | A | 12/1991 | Wilson | |
| 5,243,763 | A | 9/1993 | Persson | |
| 5,294,467 | A | 3/1994 | Hoodes | |
| 5,373,640 | A | 12/1994 | Cordeiro, Jr. | |
| 5,418,034 | A * | 5/1995 | McGuire, III | 428/106 |
| 5,649,728 | A | 7/1997 | Warthen | |
| 5,697,659 | A | 12/1997 | Calagui | |
| 5,699,618 | A | 12/1997 | Barbera | |
| 5,860,190 | A | 1/1999 | Cano | |
| 5,906,052 | A | 5/1999 | Harmon | |
| 6,254,951 | B1 * | 7/2001 | Marmalich | 428/40.1 |
| 6,276,734 | B1 | 8/2001 | Krieger | |
| 6,287,410 | B1 | 9/2001 | Klemarewski | |
| 6,379,143 | B1 | 4/2002 | Kotaki | |
| 6,379,594 | B1 | 4/2002 | Dopfner et al. | |
| 6,649,245 | B2 * | 11/2003 | Lenderink | 428/121 |
| 2002/0076569 | A1 * | 6/2002 | Giguere | 428/541 |
| 2005/0006003 | A1 | 1/2005 | Yokoo et al. | |

FOREIGN PATENT DOCUMENTS

| | | | |
|---|---|---|---|
| CA | 2027848 | A1 * | 4/1991 |
| CH | 361890 | | 6/1962 |
| CN | 11114172 | | 1/1996 |
| DE | 972 889 | | 10/1959 |
| DE | 35724 | | 1/1965 |
| DE | 2 144 085 | | 3/1973 |
| DE | 2 238 698 | | 2/1974 |
| DE | 43 165 657 | A1 | 11/1994 |
| DE | 43 18 043 | A1 | 12/1994 |
| FR | 2 242 832 | | 3/1975 |
| FR | 2 657 000 | | 1/1990 |
| WO | WO 03/003883 | A1 | 1/2003 |

OTHER PUBLICATIONS

David M. Willacy, Craft and Design in Wood, 1987, pp. 18-19, 125-126, and 139-140,Hutchinson Education, England.

* cited by examiner 20
64b
18
76
60
76
58
50a
58
44
40
42
10
14
16
36
38
34
50
54
54a
12
30
12a
52
50

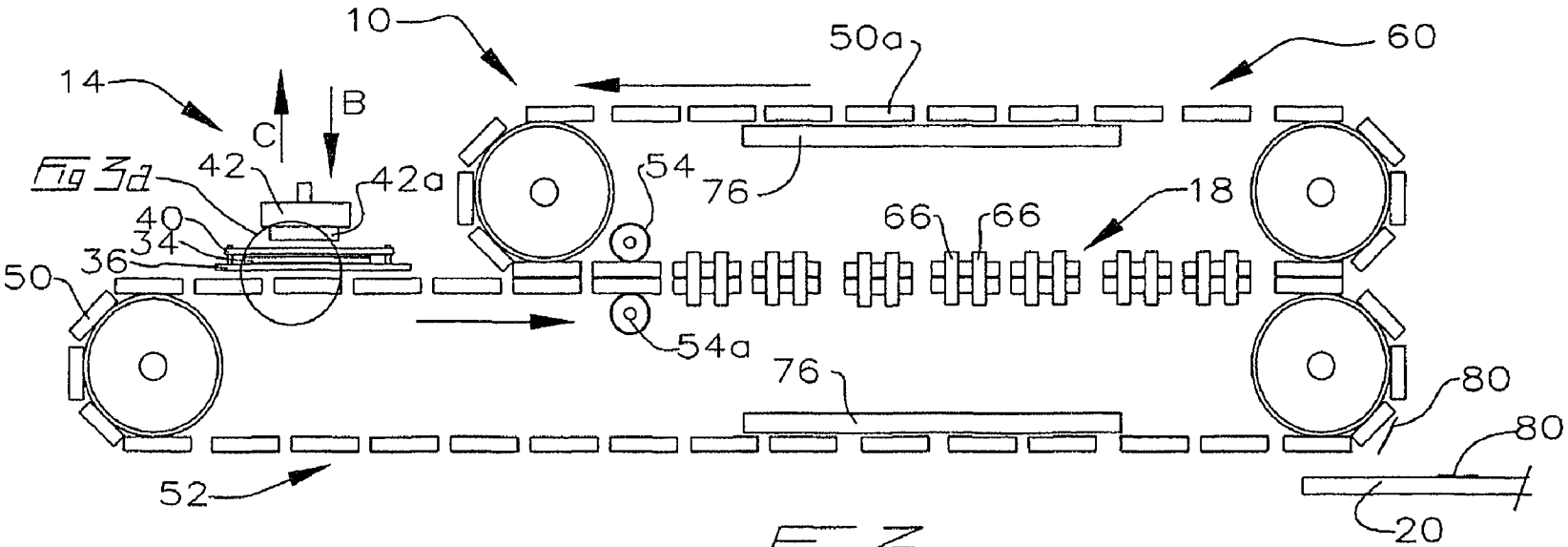
Fig 3
Fig 3a
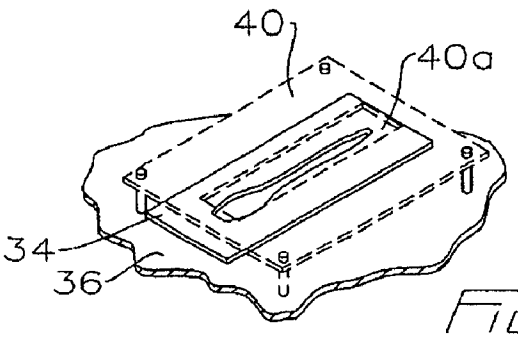

PROCESS OF PRODUCTION OF DISPOSABLE WOODEN CUTLERY AND PRODUCT THEREOF

CROSS REFERENCE TO RELATED APPLICATION

This application claims priority from U.S. patent application Ser. No. 10/569,507 filed Feb. 27, 2006 which claims priority from PCT Application No. PCT/CA2004/001569 filed Aug. 27, 2004, which claims priority from U.S. Provisional Patent Application No. 60/498,586 filed Aug. 29, 2003 entitled Process of Production of Disposable Wooden Cutlery and Product Thereof.

FIELD OF THE INVENTION

This invention relates to both an improved process for manufacturing disposable wooden eating cutlery and other utensils, and an improved design of the utensils made by that process utilizing wood veneer from generally non-marketable wood species.

BACKGROUND OF THE INVENTION

Disposable cutlery and other utensils (herein collectively referred to as utensils) manufactured from wood veneer are well known, and are gaining in popularity as these utensils are viewed as environmentally friendly in both their manufacture and disposal. However, both the design of the utensil and the process by which they are manufactured have failed to evolve so as to overcome the strength deficiencies of the thin cross-section of veneer and to overcome the inefficiencies of the manufacturing process.

Veneer strips which have been stripped from a wood block are first soaked in hot water until the lignins are softened then cut or stamped into the desired shapes, that is forks, spoons, knives and the like. The cut-outs are then placed into a mold where under pressure they are formed into the shape of the desired utensil and with the application of heat the moisture is driven off so that a stable form ensues.

In the prior art, veneer utensil shapes have been cut at one location, transported or moved to a matrix at a second location, which is further moved into vertical alignment under a die where through the application of pressure and heat the utensil is formed. Such production is invariably inefficient and is severely limited in its production capacity.

For example, in the prior art applicant is aware of the German Patent No. DE 43 18 043 A1 which issued Dec. 1, 1994 to Langer et al. for A Method for Forming Flat Parts of Wood. In this application the cut cutlery blanks are formed at the perimeter of a revolving multi-stationed table. The blanks are radially translated from their initial cutting location on to a lower portion of a form positioned on the table. Incremental rotation of the table brings the lower form into vertical alignment with an upper form, which can then be pressed together with the lower. The mated forms are then rotated to a heating station and then to a dispensing station.

In general, applicant has found that prior art wooden veneer utensils such as forks suffer from breakage of the handle near its confluence or intersection with the head of the utensil. Consequently, in applicant's view the related prior art production processes are not only inefficient and fairly slow but have produced inferior product.

It is therefore one of the objects of this invention is to provide a utensil design, for example useful for forks and spoons, or combinations thereof, which will strengthen the neck between the handle and the load-engaging member or head so as to avoid breakage of the utensil at the neck, and to provide a method and process for making same.

SUMMARY OF THE INVENTION

The present invention is a process for manufacturing eating utensils, such as knives, forks and spoons from non-merchantable timber balks where veneer is peeled from the balk, soaked in hot water and fed onto a die table containing one or more specifically shaped apertures. Veneer strips which have been stripped from a wood block are first soaked in hot water until the lignins are softened then cut or stamped into the desired shapes, that is forks, spoons, knives and the like. The cut-outs are then placed into a mold where under pressure they are formed into the shape of the desired utensil and with the application of heat the moisture is driven off so that a stable form ensues. Veneer pieces may be placed upon the die table immediately underneath a waste stripping plate which is securely mounted to and spaced above the die and which is suitably apertured so as to allow free through passage of the projecting punches. Upon completion of a punching cycle, the punches are withdrawn from the veneer through the apertures of the waste stripping plate ensuring that complete separation occurs of the punches and the remainder of the waste veneer.

Cutlery cut-outs are formed by the pressure of a vertically actuated press, the face of which contains projecting punches conforming closely to the apertures in the die table which force the veneer pieces completely through the die table.

Female molds mounted to an endless conveyor passing under the die carry the cut-outs into close proximity with male molds positioned on an endless conveyor in vertical alignment immediately above it.

Clamps mounted on endless conveyors, laterally disposed on each side of the male and female mold conveyors are adapted to bring the male and female mold components into further close proximity so as to transfer the mold shapes to the cutlery veneer. The endless conveyors carrying both the male and female molds pass through heaters, such as a microwave source for example, which maintain the mold elements at a suitable temperature for curing the cutlery.

Mold components are readily removable from the platens for replacement of defective molds or for installing molds for forming different utensils.

The mold components for forming forks and similar utensils are designed to create a dorsal rib extending along the handle and well into the head of the utensil, such as the bowl to strengthen the handle at the confluence with the head so as to avoid breakage.

In summary, the present invention is a disposable wooden utensil and a method and process for making same. The utensil may be characterized as including a handle having a distal end and an opposite neck end. A load-engaging member extends cantilevered from the neck end in generally coplanar alignment with the handle so as to form a neck between the handle and the load-engaging member. A raised dorsal ridge is formed substantially medially along the handle and extends substantially along the load-engaging member. The handle, the load-engaging member and the dorsal ridge have a contiguous upper surface and an opposite contiguous lower surface. The upper surface and the lower surface of the handle, the load-engaging member and the dorsal ridge may be formed from common sheets of wood veneer. The dorsal ridge may be linear, and may extend from the neck and along the load-engaging member between at least one third and substantially one half of the length of the load-engaging member. The utensil may be formed of at least one sheet of wood veneer. Advantageously, the load-engaging member is formed as the head of a piece of cutlery for engaging food.

In one embodiment, the utensil is formed as a lamination of at least two sheets of wood veneer. The lamination is between the upper surface of the utensil and the lower surface of the utensil, and in the handle, formed in a plane substantially containing the handle. The lamination may be of wood veneer sheets from different species of wood, for example wood chosen from the group consisting of non-merchantable species such as Aspen and Birch. The lamination may be laminated with a corn starch binder.

In a further embodiment wherein each sheet of wood veneer has a corresponding grain angle, the grain angle of adjacent sheets of wood veneer is mismatched between the adjacent sheets.

In one exemplary process according to the present invention for producing a disposable wooden utensil, the process includes forming from at least one sheet of wood veneer a handle having a distal end and an opposite neck end; forming from the at least one sheet of wood veneer a load-engaging member extending cantilevered from the neck end in generally coplanar alignment with the handle so as to form a neck between the handle and the load-engaging member; and, forming from the at least one sheet of wood veneer a raised dorsal ridge substantially medially along the handle and extending substantially along the load-engaging member. In the process each sheet of the at least one sheet of wood veneer is shaped or formed into an outline of the utensil by pressing at least one punch against a sheet of wood veneer which is sandwiched between the at least one punch and correspondingly shaped apertures in a die table, and is molded to form the utensil in mating male and female molds. The at least one sheet of wood veneer may advantageously be heated in a solvent prior to being shaped into an outline of the utensil so as to soften lignins in the wood veneer. The molds may be heated so as to cure the utensil in the molds.

BRIEF DESCRIPTION OF THE DRAWINGS

FIG. 3 is a sectional view taken on line 3-3 in FIG. 1.

FIG. 3*a* is an enlarged isometric view of a portion of FIG. 3.

DETAILED DESCRIPTION OF EMBODIMENTS OF THE INVENTION

Figures 1, 5:
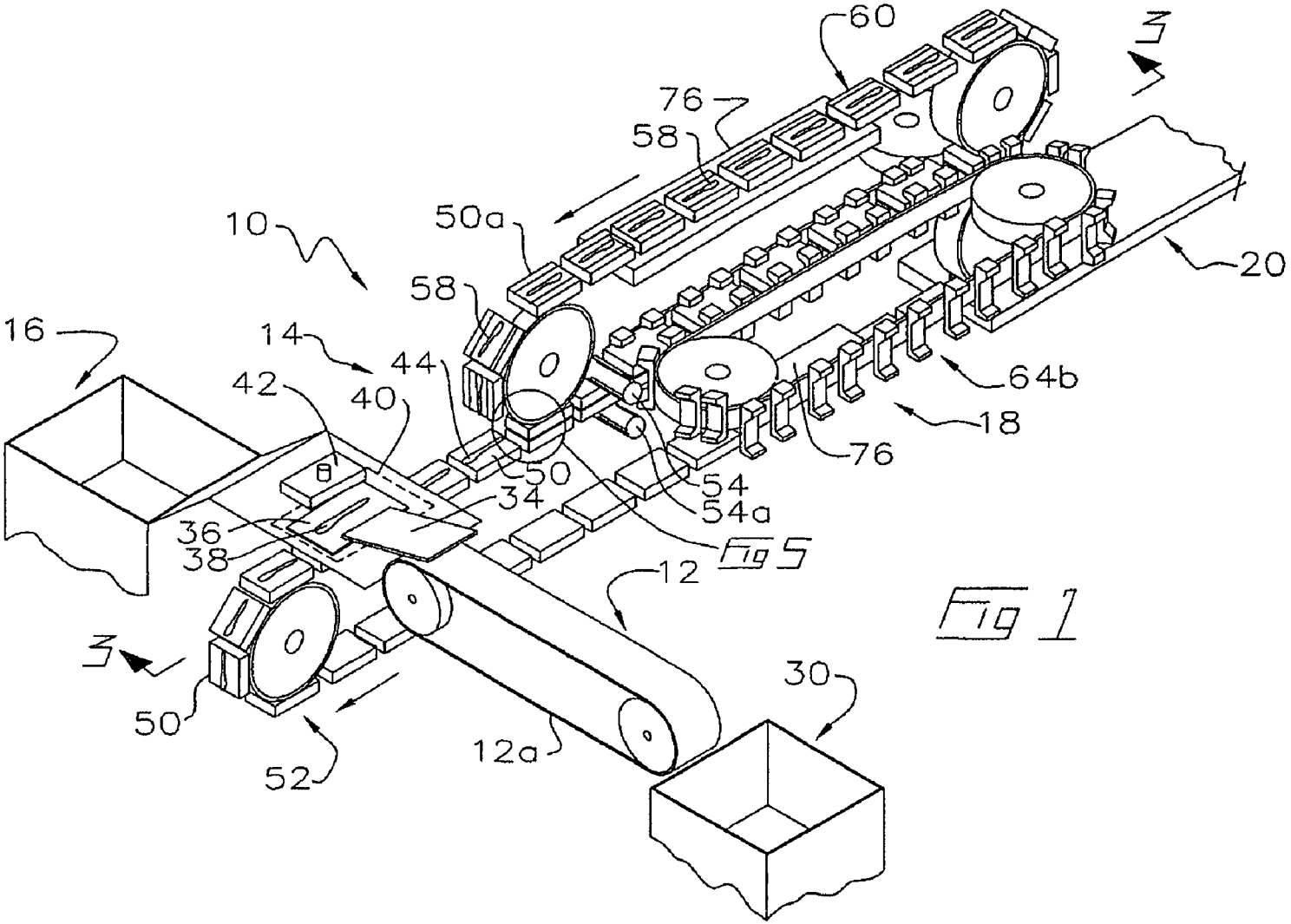
FIG. 1, is a schematic isometric view of the manufacturing process according to one aspect of the present invention.
FIG. 5 is an exploded isometric view of the upper and lower platens of FIG. 4 illustrating the male and female molds for one form of utensil.

With respect to fibre selection, the selection of appropriate source logs for production of wooden cutlery is important. Balk material which is stressed from knots or sweeps results in twisted end product and is therefore unacceptable. The challenge throughout is to avoid the end-product being twisted, spiraled or corkscrewed. Infeed material should be in the range of 10" to 20" diameter. Typically, logs are delivered in approximately 9 foot lengths, which is appropriate for 5 balks each. Balks are cut to 18½" lengths, debarked, made round and have their centre points identified for veneering lathe mounting.

Debarked balks are veneered at approximately 0.038" thickness, with outside width set at 17¾" and a centre-line score set at 8⅞" for ease of folding. Folding along the score creates two thicknesses of veneer each 8⅞" wide. The veneering process should be conducted using the "pith centre" of the balk as the radius turning centre, otherwise, stresses in the layered veneer cause twisting in the finished product. Thus, there can be no optimized veneer harvesting from balks. Veneer coming off the lathe is rolled onto a drum equipped with an automatic tensioner and stored as one drum per balk.

As used herein, and as would be known to one skilled in the art, the term "winter wood" refers to the dark-ring wood peeled off a balk during veneering on the lathe, and the term "summer wood" refers to the white-ring wood peeled off the balk during veneering on the lathe. Thus as a balk is veneered, the resulting veneer sheet has portions of winter wood interleaved between portions of summer wood. Applicants have determined that there exists different characteristics between winter and summer wood in Aspen and Birch wood which lend to improvements in production of and quality of the wooden cutlery which are the subject of the present invention.

Veneer is taken off the storage drum, examined for imperfections, and cut as required (generally into approximately 5 foot lengths). It is then fed through a series of heated-drum rolls at variable speeds and temperatures to reduce moisture content to 14-17 percent. It then has a paper ribbon glued to one edge for additional cross-grain strength required in further processing. This preconditioned veneer is set aside for a period of time to allow it to "normalize" its moisture content.

A final stage conditioning is applied after "normalizing" to further reduce moisture content on the glue side while maintaining enough moisture content on the non-glue side to prevent cracking. In particular a drum dryer at 240 degrees Celsius is used, and the pre-conditioned veneer is run over the drum, held against the drum by a one quarter inch open weave belt which allows steam to escape. It has been found that the heat of the drum causes migration of moisture away from the drum surface thereby reducing the moisture content on the drum side of the veneer and leaving an increased moisture content on the belt side of the veneer, that is the side of the veneer opposite to the drum side. The drum side of the veneer becomes the side to which glue is applied, that is, becomes the glue side.

Pre-heated veneer is fed to the glue station directly from the final stage conditioning, where it is automatically clipped to appropriate utensil length. Thermal setting food grade catalytic glue is spray applied and flashed with infrared heat. The veneer is then folded and heat sealed into a double thickness oblong "pocket" in preparation for punching into 8 product blanks, all attached to a connecting sprue (six blanks for soup spoons).

The "pocket" from the glue station is delivered to the punch station automatically. The pocket is next inserted under the steel-rule die punch via an air operated open centre "picture frame" device. On the down stroke of the punch, the product blanks are cut from the pocket. On the up stroke the waste from the pocket is left on the deck and is extracted as the picture frame returns to its "load" position. The product is retained inside the steel rule until the waste is removed. At this point the product is extracted from the die and drops to the deck. The next pocket is inserted into the picture frame and as the frame moves forward to a position under the die, the eight piece product blank with connecting sprue on the deck is moved forward and inserted into a set of heated shaping platens.

In one embodiment heated forming platens are attached to the circumference of a rotary carousel and are indexed to be positioned at the punch station each time a set of cutlery blanks are available for insertion. These platens are heated to 260 degree C. They are male and female forming platens. They close automatically, and remain closed for 5 seconds, then release momentarily for a first "gas-off" to relieve steam and then close again and remain closed for a further 25 seconds. They close with a pressure of approximately ten metric tonnes per individual utensil. The momentary pressure release is for steam release to control delamination. Variations in this procedure may occur due to moisture content requiring for example a second gas-off 10 to 20 seconds into the second compression interval. Typically veneer made from Aspen balks will require a second gas-off and veneer made from Birch balks will require only the single gas-off. But this, again, is moisture dependent. For example, sap wood has more moisture content than hardwood, etc.

The forming plattens open automatically and the product may be removed with vacuum fingers at a station which is for example 270 degrees advanced around the rotary carousel from the punch station. The "hardened", shaped utensils attached to their sprue are delivered to a moving chain where they are spray coated with confectioners glaze as a finish. The product travels though a heated tunnel to flash off the spray solvent.

The product may be next photographed for quality identification and then laser engraved as appropriate. Each individual utensil on the sprue is held by vacuum fingers and moved through a despruer where it is removed from its sprue and can be moved to its appropriate location according to its quality identification.

As noted above, the veneering process that is employed is atypical compared to the standard employed in most of the wood industry in that veneering must be based on the "growth centre" of the balks, rather than on the outside diameter of the balk (optimized recovery) as is normal in standard veneer production. Further, to make the product requires that there be significantly tighter controls on moisture content than is the case with simple veneering. A few points of additional moisture content will cause the glue to not set and delamination will take place. If there is too little moisture, the resulting cracking of for example the three dimensionally curved surfaces formed in the plattens makes the product useless. The process is multi-layer veneering, and successful veneering for the forming of product requires both cross-grain and longitudinal bending which means control of moisture content. As described above, the moisture content must be less on the glue side than on the finished surface side, and is produced in a single-sided hot drum conditioner.

Applicants have also determined that advantageously in production of wooden cutlery the several veneer layers are placed in approximate wood-grain alignment such that all layers of veneer run in the same direction. It has been found that this inhibits spiraling or corkscrewing of final product. Typically in the prior art, veneers have alternate layers placed the grain directions at approximately 90 degrees from each other such as in plywood or the like for cross-grain integrity increasing the strength. Despite the substantial alignment of grain direction in the multiple layers along the long axis of the wooden cutlery products the integrity of the final product is achieved through a mix of summer and winter wood. The summer wood, being the softer (lighter colored) annual ring fibre generated naturally within the tree during summer growth, the winter wood, being the harder (darker colored) annual ring fibre generated during winter growth, are allowed to overlap one another in the two or more layers of veneer used to form the cutlery, and in one embodiment of the process are allowed to randomly overlap. Since most loss of cross-grain integrity occurs in summer wood, it has been found that the mixing of overlapped summer and winter wood significantly reduces the loss of integrity due to co-linearity of grain direction in the layers of veneer in the lamination in wooden cutlery products according to the present invention.

Shape relationships between male and female forming platens for the various utensils are as follows:

The soup spoon requires a "compression profile" between the male and female platens wherein the male shape is required to contact the centre of the bowl to lock the veneer into place so that as the pressure increases and the veneers begin to compress, there is sufficient clearance for the cross fibers to creep rather than tearing and causing cracks. This is far different from the shape that is required for simple veneering.

The knife profile is such that the male and female shaping platens nearly meet under full pressure. This is because the knife edge requires that it be pressed to an extreme degree to make the cutting edge very thin and very hard. The design has the knife cutting teeth oriented such that the wood grain abuts the blade lengthwise rather than cross-grain, creating a cutting edge highly resistant to both wear and breakage.

The fork needs to have strong tines. This characteristic has been created through differentiated pressure during the shaping process.

The tea spoon as well as the other formed products has small radii built into the shaping platens so as to create a pleasant "mouth feel" free of roughness. The product must have smooth and hard surfaces to prevent moisture penetration as well as to create an acceptable mouth-feel and tactile sensation.

As stated above, the process is not the basic process typical in virtually all other veneering. In particular, temperature control is required and should be computer controlled for accuracy, moisture control is required for cracking prevention, and moisture control is required to the gluing process to avoid both delamination and dilution.

Figure 2:
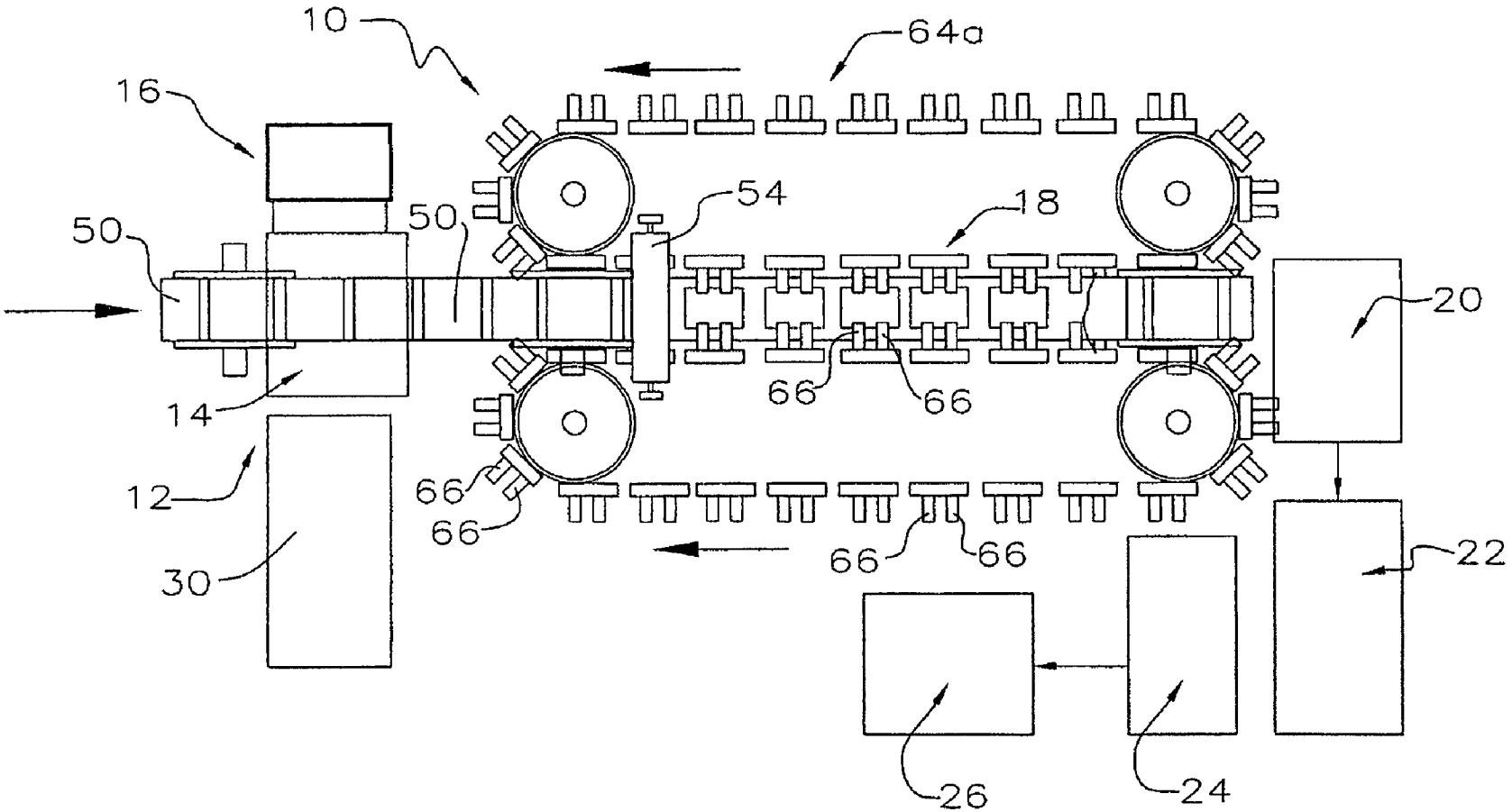
FIG. 2 is a plan view of a schematic diagram of FIG. 1.

Now, with reference to the drawing figures, wherein similar characters of reference denote corresponding parts in each view, the manufacturing apparatus 10, as schematically represented in FIGS. 1 and 2, identifies a veneer infeed area 12, a production area 14, waste receiving area 16, utensil forming area 18, utensil receiving, sorting and sanding areas 20, 22 and 24 respectively, and a sorting and packaging area 26.

As non-merchantable timber such as Birch and Aspen is utilized in this manufacturing process, it will be appreciated that such timber may be generally small in diameter and be of relatively short straight lengths. To create a relatively thin veneer from such wood with maximum utilization, the timber is first cut into balks, that is, pieces or members, of relatively short length (16 inches) prior to peeling the veneer.

Infeed area 12 includes a hot water bath 30 where wood veneer pieces 34 are soaked to soften the lignins. Softened veneer pieces 34 are fed to production area 14, for example on an endless conveyor belt 12*a*.

Veneer pieces 34 are received on a die 36 having one or more apertures 38 therein which conform to the shape of the wood utensil being manufactured. Where the saturated and softened waste veneer does not cleanly separate from punch 42*a* at the end of a punching cycle, an apertured stripping plate 40 is securely mounted to and spaced immediately above die 36. Apertures 40*a* of stripping plate 40 allow free through passage of the projecting punches on the downward utensil-forming stroke B as indicated on FIG. 3 and ensures that complete separation of the veneer from the punches occurs on the upward stroke C. A vertically operable press 42 is positioned above die 36. The lower surface of punch 42*a* seen in FIG. 3, is in the manner of male mold 58 illustrated in FIG. 5, correspondingly shaped to, and in vertical alignment with aperture 38. Operation of press 42 forces punch 42*a* through aperture 38 thereby shearing veneer 34 to form utensil cut-outs 44, which passes through aperture 38. Cut-outs 44 once pressed through aperture 38 by punch 42*a* are placed directly into a female mold 48 (best seen in FIG. 5) which is vertically aligned beneath aperture 38. Mold 48 is formed in or is removably mounted on a platen 50. A series of such platen and mold assemblies are carried by an endless conveyor 52 so as to continuously place a receiving female mold 48 in position beneath aperture 38 to accept utensil cut-outs 44.

Male molds 58 formed on or are removably mounted on platens 50*a*. Platens 50*a* are downstream of press 42 and die 36. Platens 50*a* are positioned to vertically align male molds 58 above female molds 48. Platens 50*a* are carried on an endless conveyor 60. Male molds 58 are thereby brought continuously into alignment over utensil cut-outs 44 carried in female molds 48.

Figure 4:
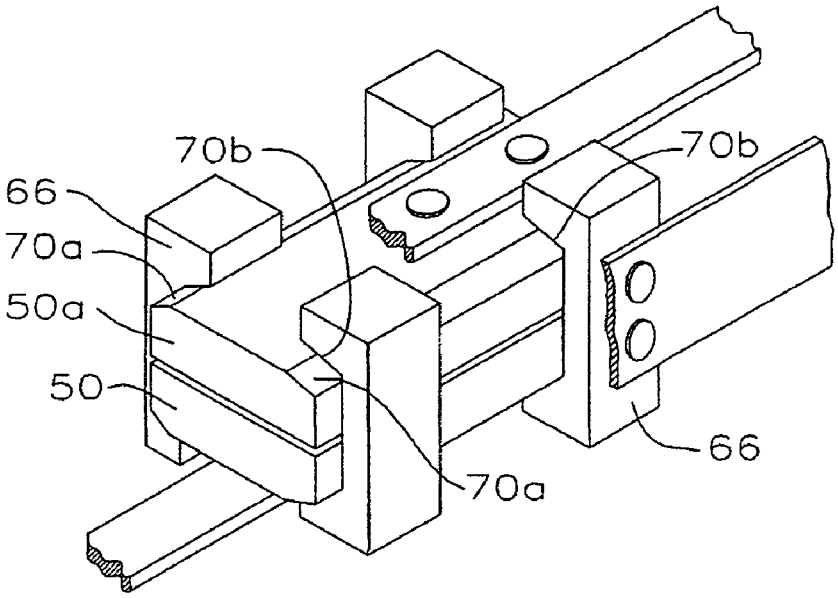
FIG. 4 is an isometric view of the upper and lower platens engaged by the clamps in the process of FIG. 1.
Figure 5:
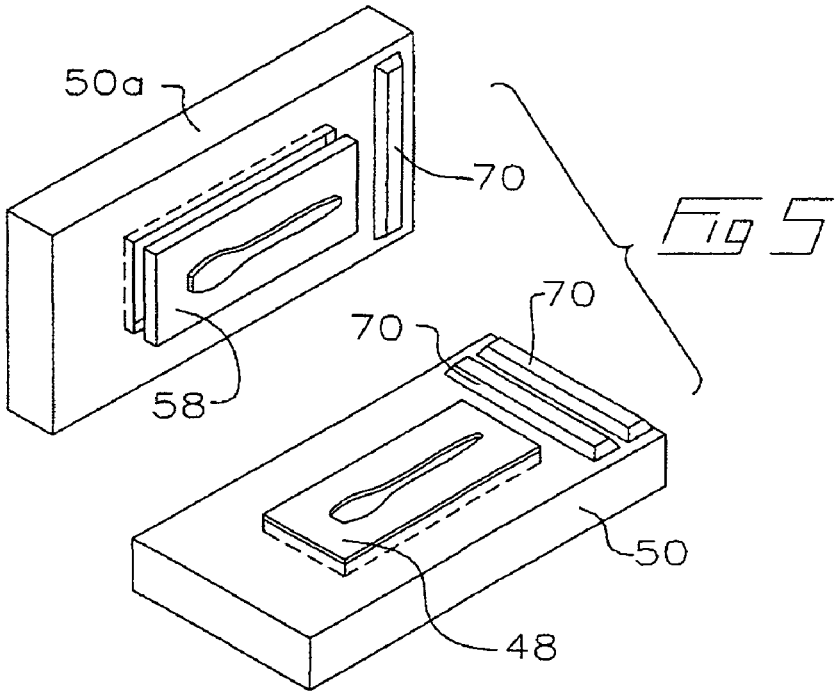
Figure 6:
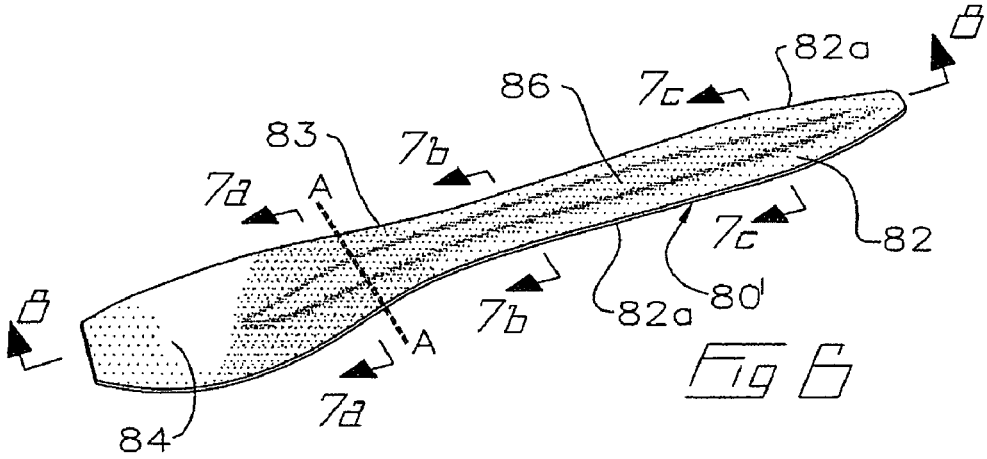
FIG. 6 is an isometric top view of one form of utensil illustrating a dorsal ridge running in to the bowl.
Figure 7:
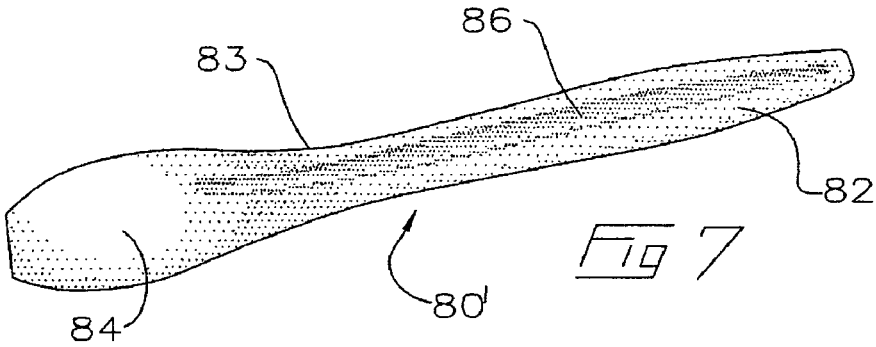
FIG. 7 is an isometric bottom view of one form of utensil illustrating a dorsal ridge running in to the bowl.
Figure 7A:
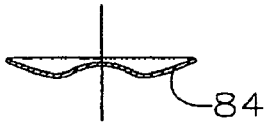
FIG. 7*a* is a sectional view taken on line 7*a*-7*a* of FIG. 6.
Figure 7B:
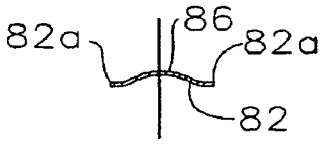
FIG. 7*b* is a sectional view taken on line 7*b*-7*b* of FIG. 6.
Figure 7C:
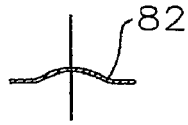
FIG. 7*c* is a sectional view taken on line 7*c*-7*c* of FIG. 6.
Figure 8:
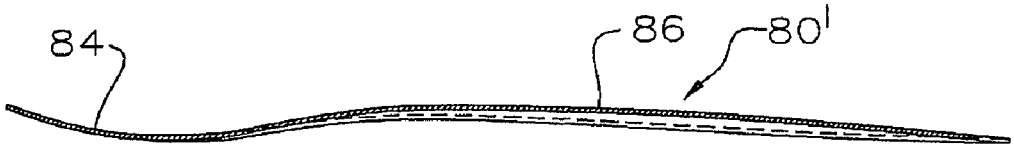
FIG. 8 is a longitudinal sectional view taken on line 8-8 of FIG. 6.
Figure 9:
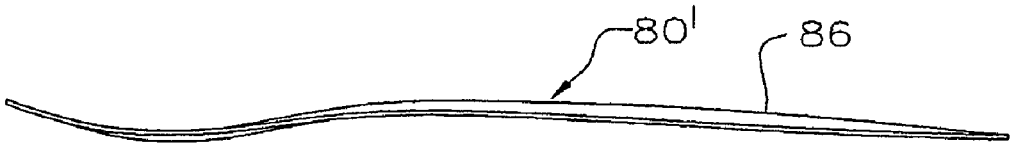
FIG. 9 is a side view of the utensil illustrated in FIG. 6.

Upper and lower press rolls 54 and 54*a* respectively engage upper and lower platens 50 and 50*a* bringing them tightly together. Endless conveyors 64*a* and 64*b* are laterally disposed on either side of upper and lower male and female mold carrying conveyors 60 and 52 respectively. Conveyors 64*a* and 64*b* carry a series of 'U' shaped clamps 66 in opposed facing parallel array along a mid-section under platens 50*a*. As seen in FIG. 4 as clamps 66 are brought into engagement with the nested pairs of male and female platens, while they are experiencing the compressive force from press rolls 54, thereby maintaining compression upon the saturated utensil cut-out carried sandwiched therebetween. The mating surfaces of platens 50 and 'U' shaped clamps 66 have complimentary beveled surfaces 70*a* and 70*b* respectively allowing clamp 66 to readily engage platens 50 and 50*a*.

The endless conveyors carrying upper and lower platens 50 and 50*a* respectively and clamps 66 pass through or adjacent to heaters 76 or other non-contact applied-radiation sources such as for example, a microwave source so that, in one embodiment not intended to be limiting, they are maintained at a temperature of approximately 400 degrees Fahrenheit, wherein such a temperature provides for curing of the shaped utensil cut-out in a time of approximately 90 seconds.

As will be noted in FIG. 5, the platens molds are maintained in close nested alignment by means of locking bars 70 or other alignment means projecting from or otherwise mating between the abutting faces. The platens and molds may be manufactured from various metallic compositions to enhance wear and heat retention as would be known to one skilled in the art.

In FIGS. 6 through 9 a utensil 80 formed by the above process is illustrated. Each utensil according to the present invention has a handle 82 and a load-engaging member 84 such as the bowl of a spoon or the tines of a fork, etc. The handle and the load-engaging member are jointed at a neck 83. The illustrated example is a spoon 80'. A fork or a combination spoon and fork may be similarly formed. Spoon 80 has a handle 82 and a load-engaging member 84 formed as a bowl. A dorsal ridge 86 is formed medially of the sides 82*a* of handle 82. Ridge 86 extends well past the neck 83, that is the confluence of the handle 82 with the bowl 84. Line A-A may coincide with the greatest stress concentration when the load-engaging member engages a load, such as piercing into food and levering a piece therefrom, when the force is applied by a user grasping the handle and driving the load-engaging member into the food. Line A-A has thus been identified as the location where breakage most often occurs in prior art disposable utensils lacking the equivalent of dorsal ridge 86. Ridge 86 may advantageously extend one third to one half the length of load-engaging member 84.

Figure 10:
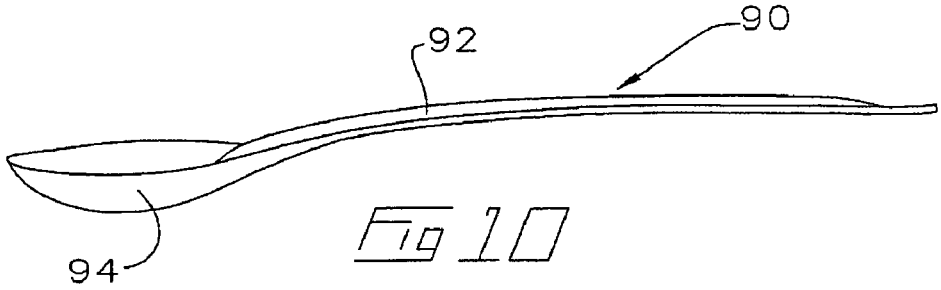
FIG. 10 is a side view of an alternative form of the utensil.
Figure 10A:
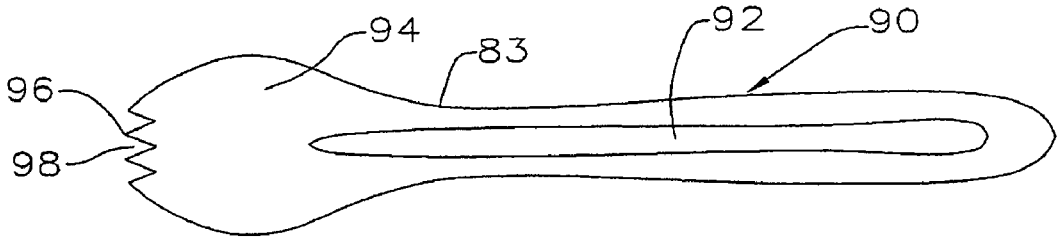
FIG. 10*a* is a plan view of the utensil illustrated in FIG. 10.
Figure 11:
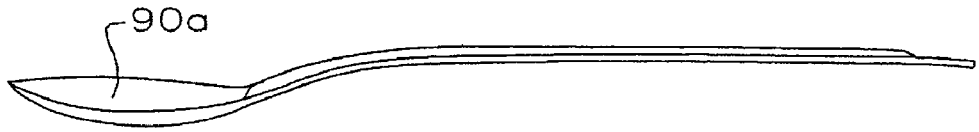
FIG. 11 is a side view of an alternative form of the utensil illustrated in FIG. 10.
Figure 11A:
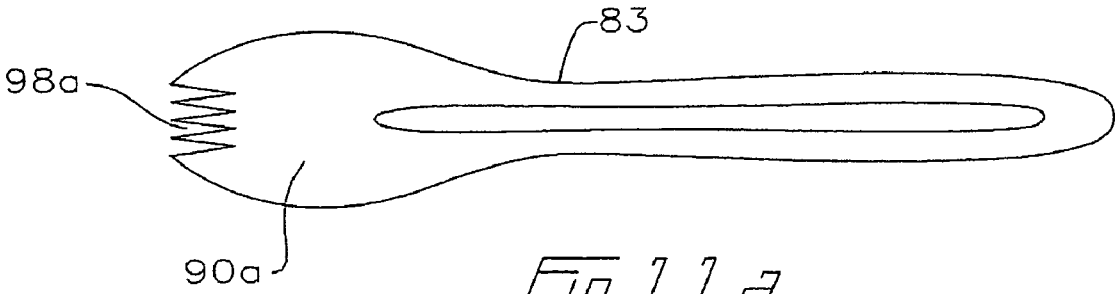
FIG. 11*a* is a plan view of the utensil illustrated in FIG. 11.

FIGS. 10, 10*a* and 11 identify a novel utensil 90, which is a combination spoon and fork, which may be referred to as a 'spork'. Utensil 90 is a further example of a utensil 80, having a medial dorsal ridge 92 on the handle which, like the ridge in utensil 80' illustrated in FIG. 6, terminates well into the head or bowl 94. The forward lip 96 of head 94 has a series of small serrations 98, which act similar to conventional fork tines for spearing or lifting comestibles. The bowl 94 of utensil 90 will retain liquids and particulate food for ready consumption. FIGS. 11 and 11*a* illustrate a slight modification to the utensil of FIG. 10 in that the spoon bowl 90*a* is shallower and the serrations 98*a* are significantly longer for easier food handling.

Figure 12:
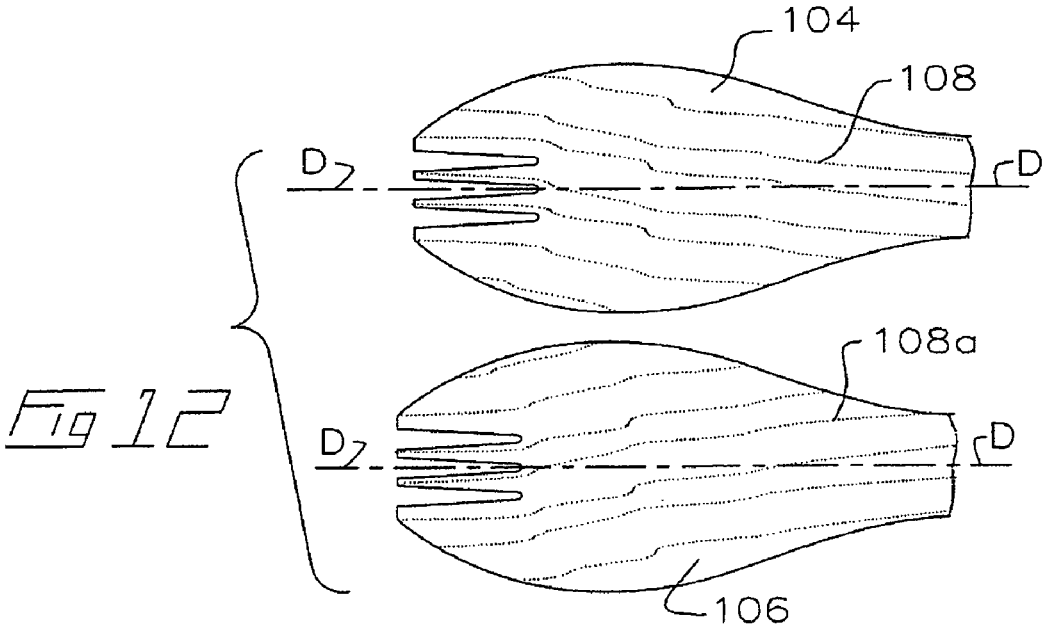
FIG. 12 is a plan view illustrating the mismatched wood grain on utensils cut from different species of wood.

It has been experienced that when cutlery is manufactured from a single piece of wooden veneer it has lacked sufficient strength unless the veneer is sliced fairly thickly. However, as the thickness of the veneer increases it is more likely to crack during the molding and curing process. To overcome this, utensil cut-outs 104 and 106, as may be viewed in FIGS. 12 and 13 may be assembled by laminations of thin veneer sheets. Two or more layers of veneer may be employed. The laminations may be cut from different species of wood, for example Aspen and Birch. The wood grain 108 and 108*a* of each lamination is generally parallel to the longitudinal axis D of the utensil cut-out and when they are superimposed the grain of the different wood species are inherently mismatched. Otherwise the grain angle between layers may be mechanically mismatched, mismatching of the grain between adjacent layers appearing to increase the stiffness and strength of the resulting utensil although potentially introducing spiraling or corkscrewing of the end product. A veneer of forty thousands of an inch thickness can then be utilized for the manufacture of the wooden cut-outs and laminated to produce sturdy eating utensils, with increased resistance to bending and torsion, in particular at the neck constriction of the utensil.

Bonding together of the utensil cut-outs is accomplished by the use of a non-toxic thermal setting binder 110, for example corn starch or other similarly non-toxic medium, which is applied to the exposed surface 106*a* of the lower cut-out 106. Utensil cut-outs are then vertically aligned, placed in contact with each other and inserted into the molds.

Figure 13:
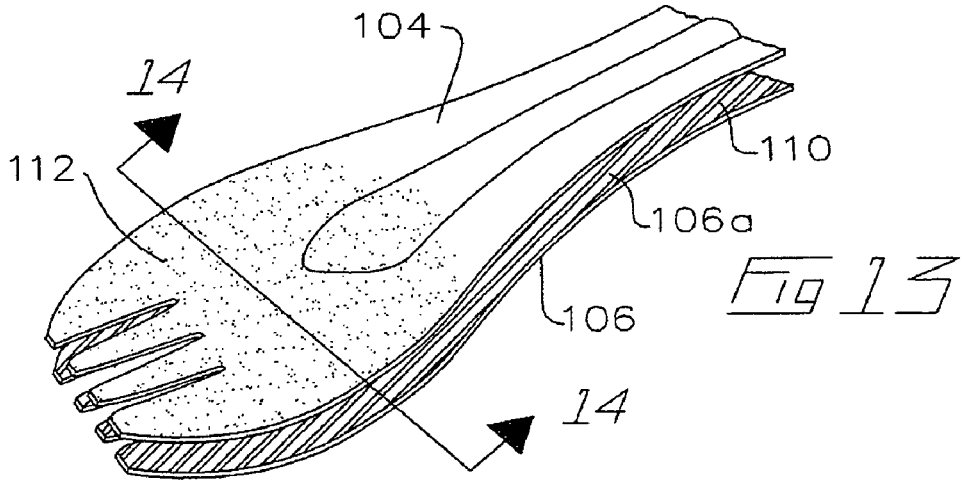
FIG. 13 is a partially exploded perspective view of an end of a utensil according to the present invention illustrating the laminations separated.
Figure 14:
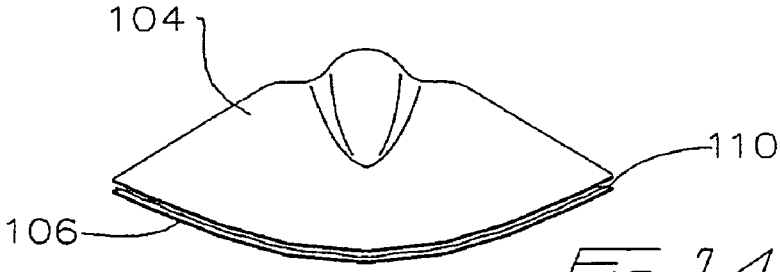
FIG. 14 is a sectional view taken along line 13-13 of FIG. 12.
Figure 15:
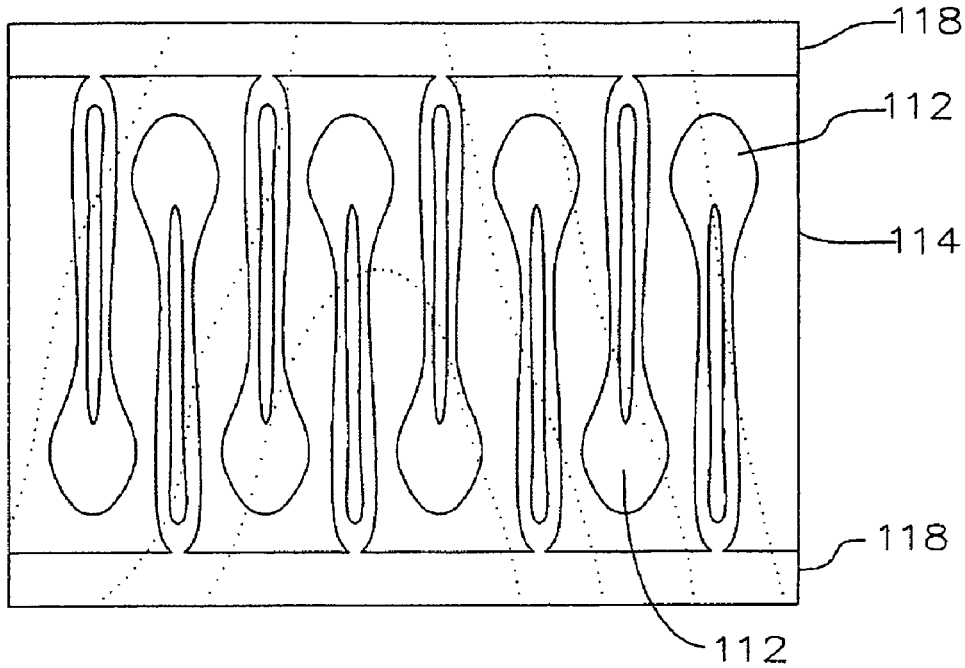
FIG. 15 is, in plan view, a veneer blank showing the outline of spoon shapes in the blank.
Figure 16:
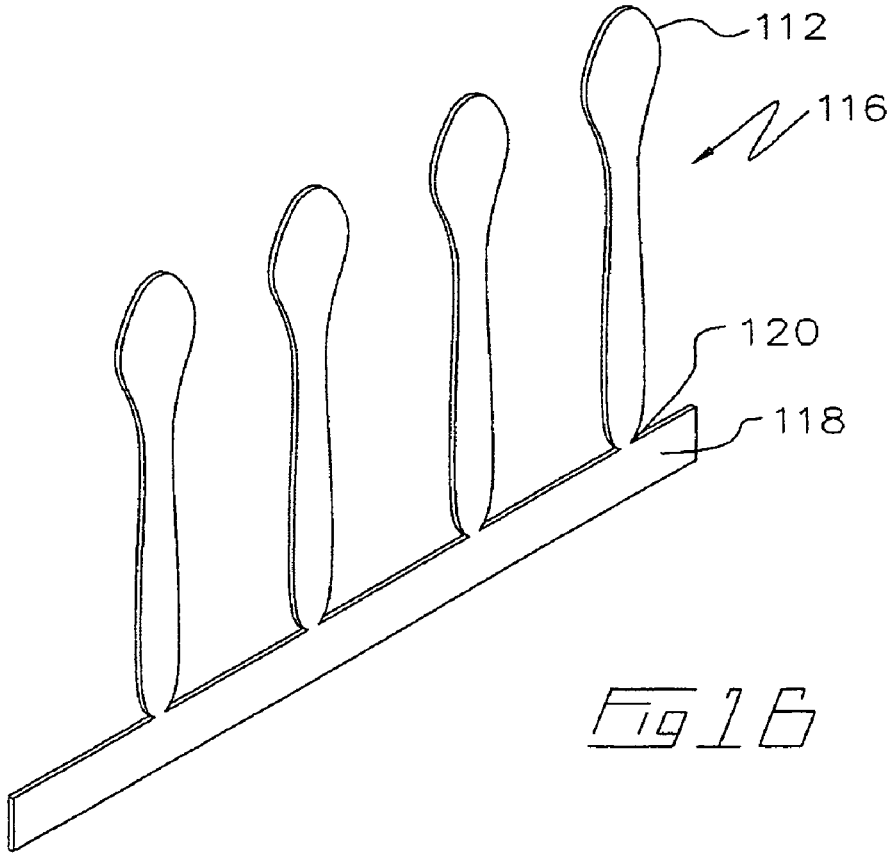
FIG. 16 is, in perspective view, an array of spoon shapes which have been removed from the veneer blank of FIG. 15.

The portion of the utensil which comes into contact with food or which is inserted into the mouth may be coated or sealed, for example with an edible wax product as illustrated at 112 on FIG. 13.

In an alternative process for producing the cutlery according to the present invention, spoon shapes 112 are stamped out of or otherwise removed from a veneer blank 114 so as to produce a spaced apart parallel array 116 releasably mounted to a common linear member 118 also formed from veneer blank 114. In the preferred embodiment, veneer blank 114 may be used to produce two arrays 116 by stamping the arrays of spoon shapes 112 in opposed facing relations so as to interleave the opposed facing spoon shapes 112. Once an array 116 has been stamped from veneer blank 114, individual spoon shapes or blanks 112 may be removed from member 118 by releasing each spoon blank 112 at a constriction or joint 120.

Figure 17:
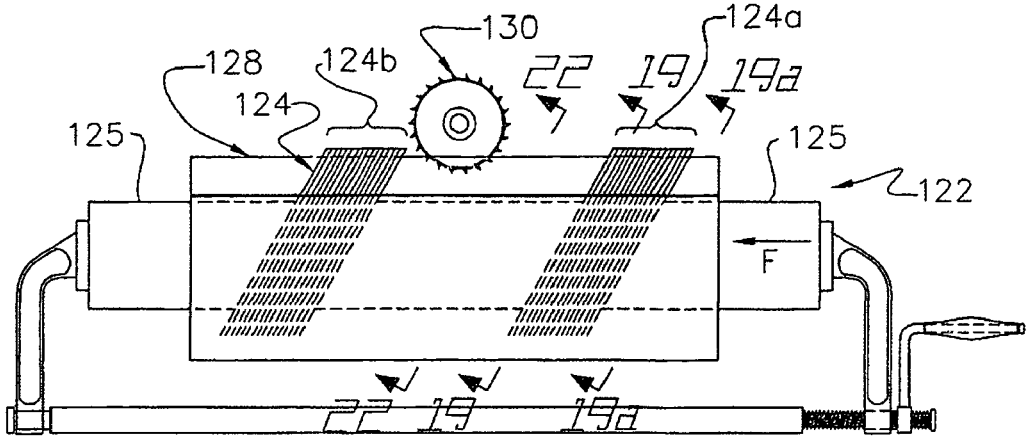
FIG. 17 is, in side elevation view, a clamp and jig holding between the ends of the clamp closely pressed arrays of spoon blanks.
Figure 18:
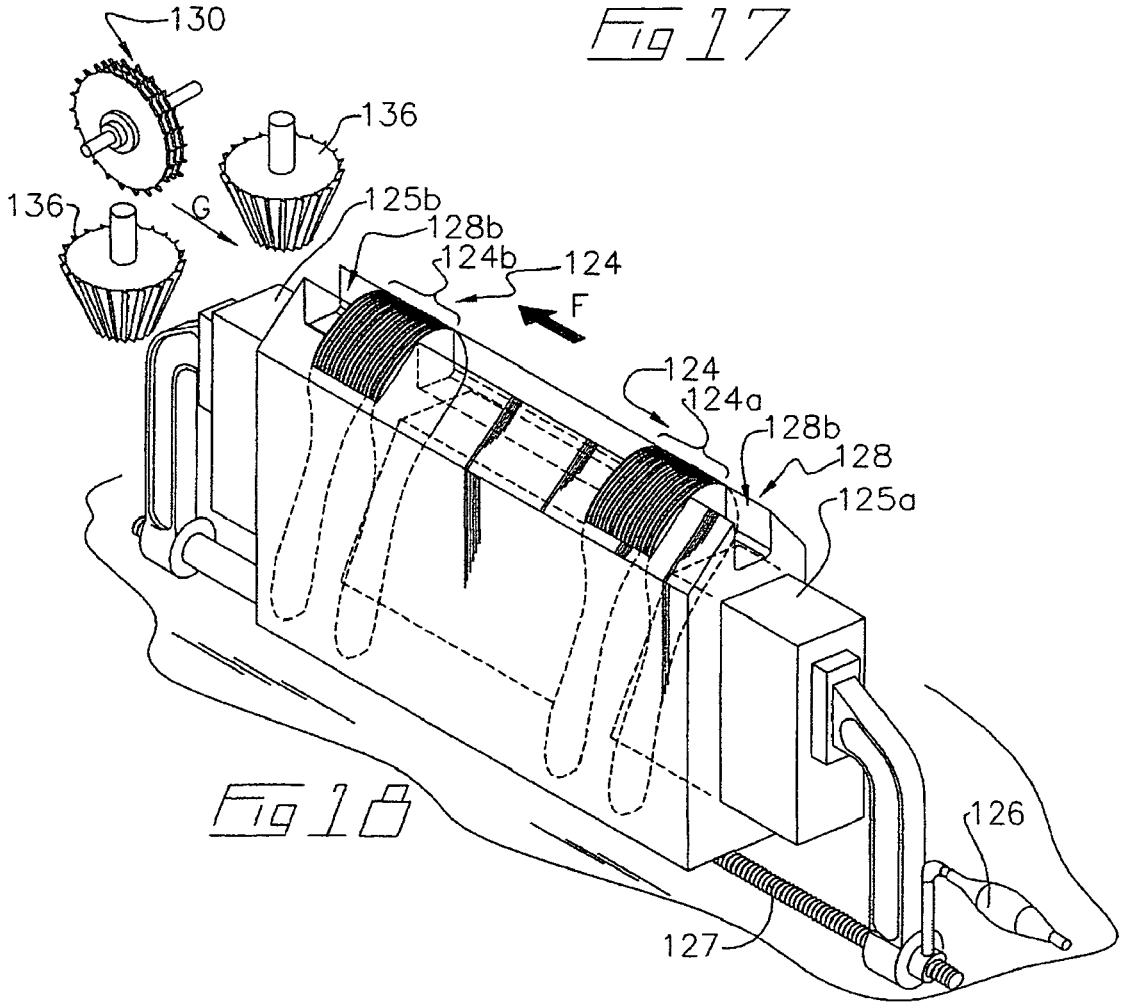
FIG. 18 is, in perspective view, the clamp, jig and spoon blanks of FIG. 17 illustrating cutting tools for engaging the upper ends and sides of the spoon blanks.
Figure 19:
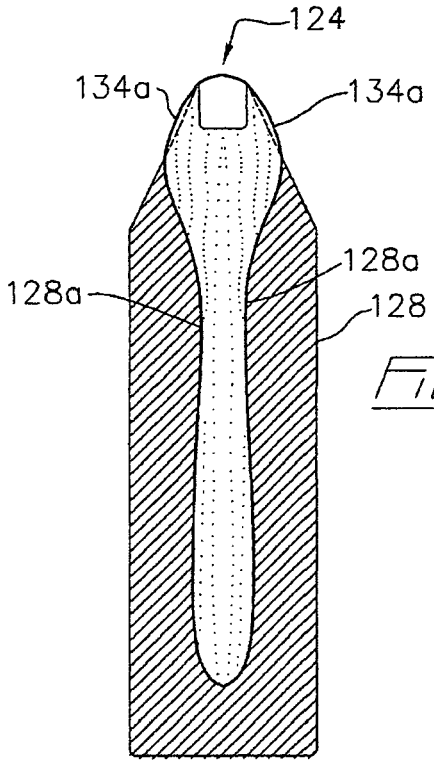
FIG. 19 is a sectional view along line 19-19 in FIG. 17.
Figure 19A:
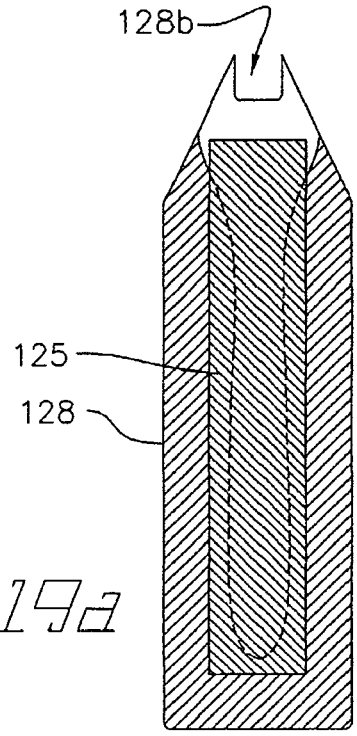
FIG. 19*a* is a sectional view along line 19*a*-19*a* in FIG. 17.
Figure 20:
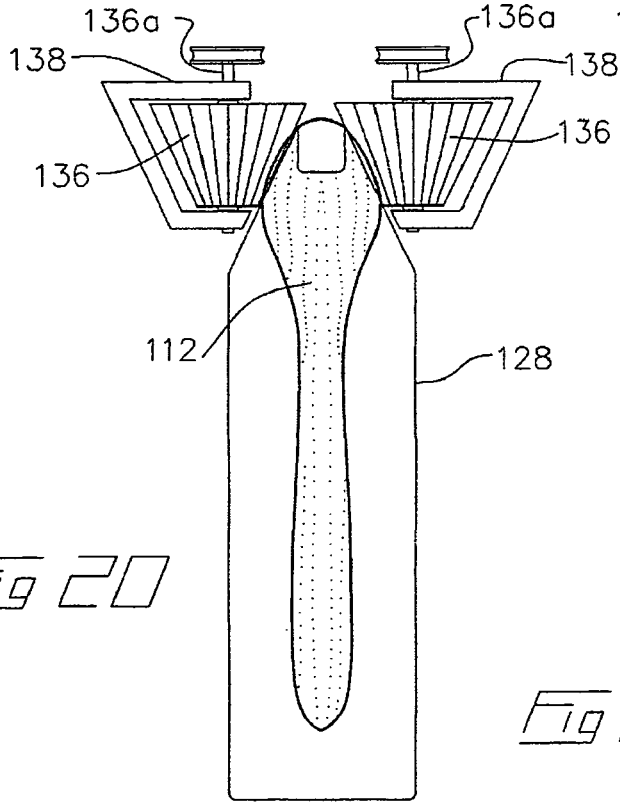
FIG. 20 is an end elevation view of the laterally spaced apart pair of reducing beads of FIG. 18 engaging the exposed upper end of the spoon blanks held within the jig.
Figure 21:
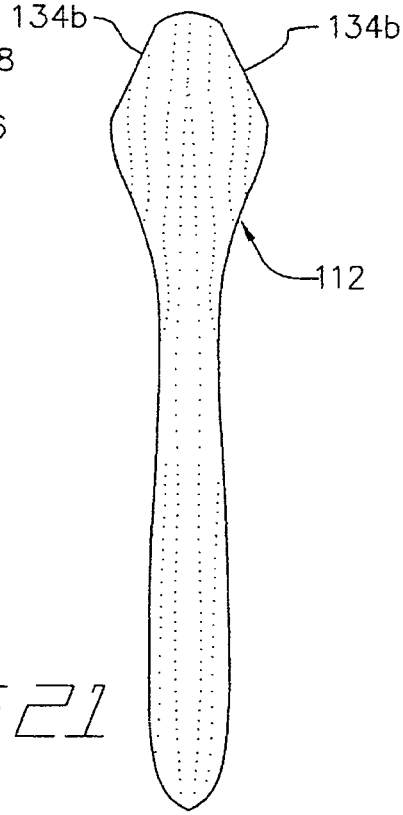
FIG. 21 is, in plan view, the spoon blank of FIG. 20 after it is trimmed.
Figure 22:
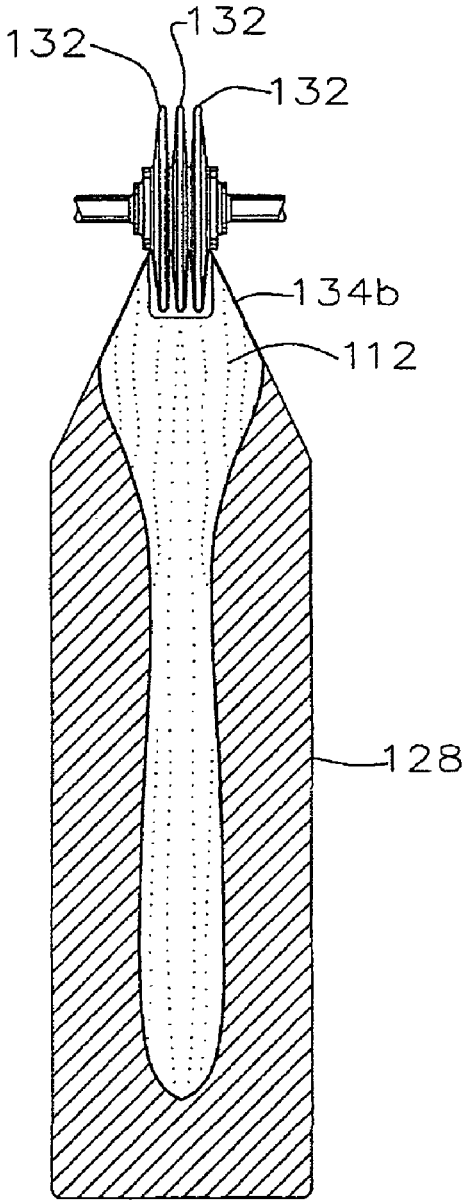
FIG. 22 is a cross-sectional view along line 22-22 in FIG. 17.
Figure 23:
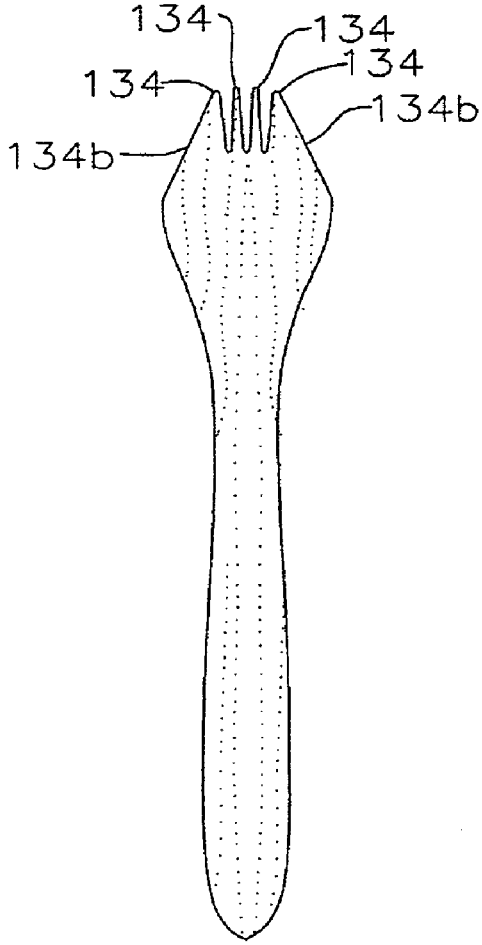
FIG. 23 is, in plan view, the spoon blank of FIG. 22.

The spoon blanks 112 once removed from their corresponding arrays 116, may be loaded into a manually operable press or clamp 122. Once loaded into press 122, the spoon blanks 112 form aligned closely adjacent blocks 124 having the outline of a spoon shape. Two such blocks 124*a* and 124*b* are illustrated in FIGS. 17 and 18 as being loaded within clamp 122, inclined relative to opposed facing clampheads 125*a* and 125*b*. In the embodiment illustrated, which is not intended to be limiting, the clamp 122 is in the form of a bar clamp wherein rotation of handle 126 on threaded spindle 127 translates head 124*a* in direction F so as to compress spoon blocks 124 against the opposite clamp head 125*b*.

A jig 128 is mounted suspended between heads 124*a* and 124*b*. Head 124*a* is slidably journalled in jig 128 so as to translate in direction F into a correspondingly sized cavity, thereby pressing against spoon block 124*a*. Similarly, head 125*b* compresses spoon block 124*b*. The spoon blocks 124*a* and 124*b* are held snugly within a correspondingly shaped cavity 128*a* within and extending longitudinally along the length of jig 128.

With the spoon blocks 124 held rigidly within jig 128, a cutter head 130 may be translated either manually or along sliding setworks (not shown) so as to pass, in the illustrated embodiment which is not intended to be limiting, the three spaced apart cutter head blades 132 into cutting engagement with the top of each spoon block 124 as the blades 132 translate along the length of channel 128*b* formed in the top of jig 128. Thus as cutter head 130 and the rotating cutter head blades 132 translate in direction G along channel 128*b*, the individual blades 132 cut the top of each spoon blank 112 within each spoon block 124 so as to form tines 134.

In a preferred embodiment, a pair of laterally opposite reducing heads 136 are also translated along the upper beveled edges of jig 128 so as to trim the exposed edges 134*a* from the top of each spoon blank 112 within spoon blocks 124 so as to form flat surfaces 134*b* thereby altering the shape of the end of each spoon blank 112 into a shape resembling that of a fork. The combined utensil then may be used as either a fork or a spoon. Reducing heads 136 may be rotatably mounted within brackets 138 on drive axles 136*a*.

Figure 24:
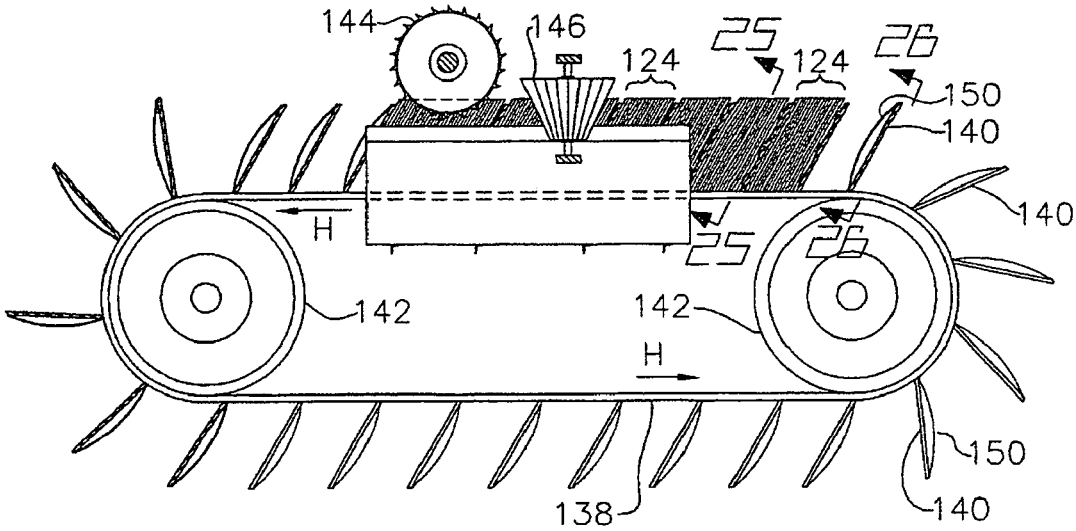
FIG. 24 is, in side elevation view, a further alternative embodiment of a device for automated manufacturing of the utensil of FIG. 23.
Figure 25:
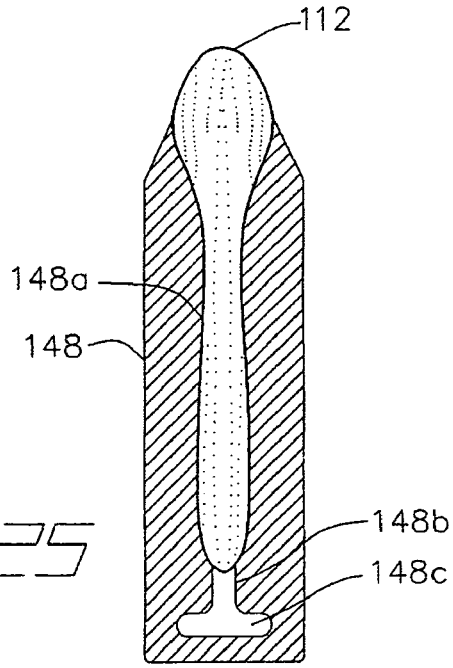
FIG. 25 is a sectional view along line 25-25 in FIG. 24.
Figure 26:
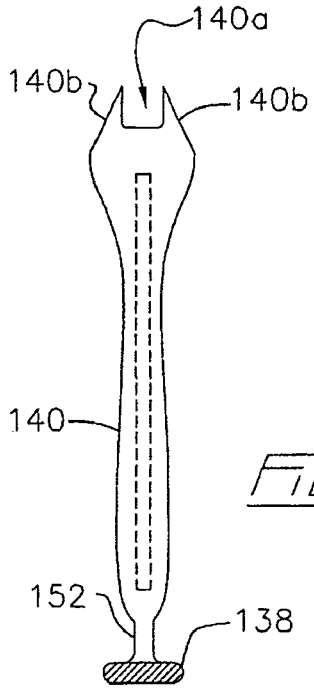
FIG. 26 is, in end elevation view, one supporting arm from the device of FIG. 24.

In an alternative process, in one example of automating the above described manual process for manufacturing the combination fork and spoon, and as better seen in FIGS. 24-26, spoon blocks 124 are loaded onto an endless conveyor 138 between rigid supporting arms 140 mounted around the perimeter of conveyor 138 so as to extend outwardly therefrom. Each of supporting arms 140 is shaped so as to sandwich against or cup the ends of spoon blocks 124, so as to hold them snugly therebetween leaving the upper ends of spoon blanks 112 and corresponding upper ends of spoon blocks 124 into notches 140*a* in arms 140 or protruding above the rigidly outermost ends of supporting arms 140. The radially outer ends of supporting ends 140 are notched with notches 140*a* so that as conveyor 138 translates in direction H around idler and drive sprockets 142, the upper ends of spoon blocks 124 are translated through rotating saws 144. Saws 144 may be for example three saws closely spaced in the manner of saws 132 so as to pass through the notches 140*a* in the outer ends of supporting arms 140 to thereby form tines 134 in the spoon blanks 112 held within spoon blocks 124.

As spoon blocks 124 are translating on conveyor 138 in direction H they may also be trimmed by the laterally opposite pair of reducing heads 146 (only one of which is shown) so as to form sides 134*b* on spoon blanks 112. As spoon blocks 124 are nearing reducing heads 146 and saws 144, the spoon blocks are translated into and along correspondingly shaped cavity 148*a* within elongate rigid jig 148. The upper end of each supporting arm 140 has bevels 140*b* so as to not interfere with reducing heads 146 as the supporting arms 140 are translated in direction H between the reducing heads and under the saws 144.

Each of supporting arms 140 may be held in place by, for example, a spring plate 150 also mounted to conveyor 138. Supporting arms 140 may be thus formed with the same profile outline as a spoon blank 112 that has been trimmed and sawn, supporting arms 140 and may be connected to conveyor 138 by a neck 152 so as to pass through a corresponding narrow channel 148*b* between cavity 148*a* and conveyor belt cavity 148*c*. Conveyor 138 passes through and along cavity 148*c*.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A process for producing a disposable wooden utensil, the process comprising the steps of:

a) providing at least one male platten and a corresponding at least one female platten, said at least one male platten and said at least one female platten moulded to form a wooden utensil from pre-shaped utensil blanks made from sheets of wood veneer having heat curable adhesive in a layer between said sheets when said blanks are compressed together and heated in compression between said at least one male platten and said at least one female platten, wherein said at least one male platten and said at least one female platten having a formed shape shaped to form from said blanks a utensil shape having a handle having a distal end and an opposite neck end, a load-engaging member extending cantilevered from said neck end in generally coplanar alignment with said handle so as to form a neck between said handle and said load-engaging member, and a raised dorsal ridge substantially medially along said handle and extending substantially along said load-engaging member, b) heating to a first temperature said at least one male platten and said at least one female platten, said first temperature at least sufficient to vapourize moisture in said blanks to thereby harden said blanks in said formed shape and cure said adhesive in said blanks when compressed between said at least one male platten and said at least one female platten, c) sandwiching said blanks between said at least one male platten and said at least one female platten, d) compressing to a first pressure said blanks between said heated said at least one male platten and said at least one female platten so as to apply compression to each blank in said blanks for sequential first and second time intervals, and reducing, so as to relieve said compression and releasing steam at least once including between said first and second time intervals for at least one momentary pressure reduced period for said each blank, wherein each said pressure-relief period is sufficient to release steam from between said at least one male platten and said at least one female platten.

2. The process of claim 1 further comprising the step of controlling moisture in said sheets so that wood moisture is initially reduced to 14-17% and an outside surface of said blank has greater moisture than an inner glue-side surface of said blanks.

3. The process of claim 2 wherein said wood moisture is reduced by heating said sheets on heated drums.

4. The process of claim 2 wherein said outside surfaces are at 14-17% moisture, and said inner surfaces are at less than 8-12% moisture.

5. The process of claim 1 wherein said sheets of wood veneer are lathed from a baulk to a thickness of approximately 0.038 inch per said sheet.

6. The process of claim 1 wherein each single sheet of veneer of said sheets of wood veneer is scored with a linear fold line, and wherein said each sheet of veneer is folded about said foil line to create a double thickness pocket of veneer having outer surface and inner surfaces, and said adhesive is applied to said inner surfaces.

7. The process of claim 6 wherein said pocket is heated to pre-set the adhesive.

8. The process of claim 7 wherein said pocket is punched to form said blanks.

9. The process of claim 8 wherein said first time interval is approximately 5 seconds, said second time interval is approximately 25 seconds, said first pressure is at least ten metric tonnes per said blank, and said first temperature is 145 degrees Celsius.

* * * * *